US005538187A

United States Patent [19]

Mueller et al.

[11] Patent Number: 5,538,187

[45] Date of Patent: Jul. 23, 1996

[54] FUEL INJECTION DEVICE FOR INTERNAL COMBUSTION ENGINES

[75] Inventors: Peter Mueller, Hallein; Jaroslaw Hlousek, Golling, both of Austria

[73] Assignee: Robert Bosch GmbH, Stuttgart, Germany

[21] Appl. No.: 339,684

[22] Filed: Nov. 14, 1994

[30] Foreign Application Priority Data

Dec. 7, 1993 [DE] Germany ..... 43 41 546.6

[51] Int. Cl.[6] ..... F02M 47/02

[52] U.S. Cl. ..... 239/88; 239/533.9; 239/585.1

[58] Field of Search ..... 239/88, 96, 124, 239/127, 585.1–585.5, 533.9, 533.3

[56] References Cited

U.S. PATENT DOCUMENTS

| | | | |
|---|---|---|---|
| 3,606,158 | 11/1969 | Pritchard | 239/124 |
| 3,777,977 | 11/1973 | Regneault et al. | 239/96 |
| 4,848,658 | 7/1989 | Aketa et al. | 239/96 X |
| 4,948,049 | 8/1990 | Brisbon et al. | 239/96 |
| 4,951,874 | 8/1990 | Ohnishi et al. | 239/585.1 X |
| 4,993,637 | 2/1991 | Kanesaka | 239/96 |

FOREIGN PATENT DOCUMENTS

| | | | |
|---|---|---|---|
| 206973 | 10/1985 | Japan | 239/96 |

*Primary Examiner*—Kevin P. Weldon

*Attorney, Agent, or Firm*—Edwin E. Greigg; Ronald E. Greigg

[57] ABSTRACT

A fuel injection device for internal combustion engines having a high pressure accumulation chamber, which can be filled by a high pressure fuel pump and from which high pressure lines lead to the individual injection valves. Control valves for controlling the high pressure injection at the injection valves, as well as an additional pressure storage chamber between these control valves and the high pressure accumulation chamber, are inserted in the individual high pressure lines. For a more rapid pressure relief of the injection valve at the end of injection, the valve member of the control valve has a reaspiration collar, which additionally constitutes a throttle to maintain a residual pressure in the pressure line to the injection valve, which throttle precedes the flat seat valve, which opens the communication of the injection valve to a relief chamber.

20 Claims, 1 Drawing Sheet

FUEL INJECTION DEVICE FOR INTERNAL COMBUSTION ENGINES

BACKGROUND OF THE INVENTION

The invention is based on a fuel injection device for internal combustion engines as defined hereinafter. In known fuel injection devices of this kind, a high pressure fuel pump supplies fuel from a low pressure chamber to a high pressure accumulation chamber, which communicates via high pressure lines with the individual injection valves, which protrude into the combustion chamber of the internal combustion engine to be fed; this common pressure storage system is maintained at a determined pressure by a pressure control device. To control the injection times and injection quantities at the injection valves, an electrically actuated control valve is inserted into each high pressure line of each injection valve, and by its opening and closing it controls the high pressure fuel injection at the injection valve.

The control valves at the injection valves are embodied as magnet valves, which at the onset of injection open up the communication between the high pressure line and the injection valve and close it off again at the end of injection.

The control valves in the known fuel injection devices have the disadvantage, though, that is not possible to shape the course of injection at the injection valve. Above all, the problem arises that the high fuel pressure contacting the injection valve cannot be released rapidly enough, which can result in imprecision in the control at the end of injection.

OBJECT AND SUMMARY OF THE INVENTION

The fuel injection device according to the invention has the advantage over the prior art that the end of injection can be reliably controlled by means of a reaspiration collar provided in the relief valve. This reaspiration collar withdraws fuel from the pressure line to the injection valve during the closing motion of the control valve member so that a rapid pressure drop is guaranteed in the injection valve at end of injection.

A further advantage is achieved by the arrangement of an annular shoulder in the pressure chamber that acts in the opening direction of the valve to open the communication between high pressure line and injection valve, via which a safety function can be integrated into the control valve. This annular shoulder is designed so that when a predetermined maximal pressure is exceeded in the high pressure line and in the pressure chamber, it frees the opening cross section to the annular chamber by a slight measure, which is small, so that the opening cross section at the valve seat, which controls the communication between the annular chamber and a relief chamber, is not completely closed so that the excess fuel pressure is released from the annular chamber into the relief chamber and then into a return line to the low pressure fuel chamber.

It is advantageously possible, by means of the throttle provided on the reaspiration collar, to adjust the outflow process of the fuel out of the pressure line from the injection valve during the injection pauses so that a determined residual pressure remains in the pressure line.

It is furthermore possible to shape the course of injection at each injection valve by the provision and dimensioning of an additional pressure storage chamber at each injection valve.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
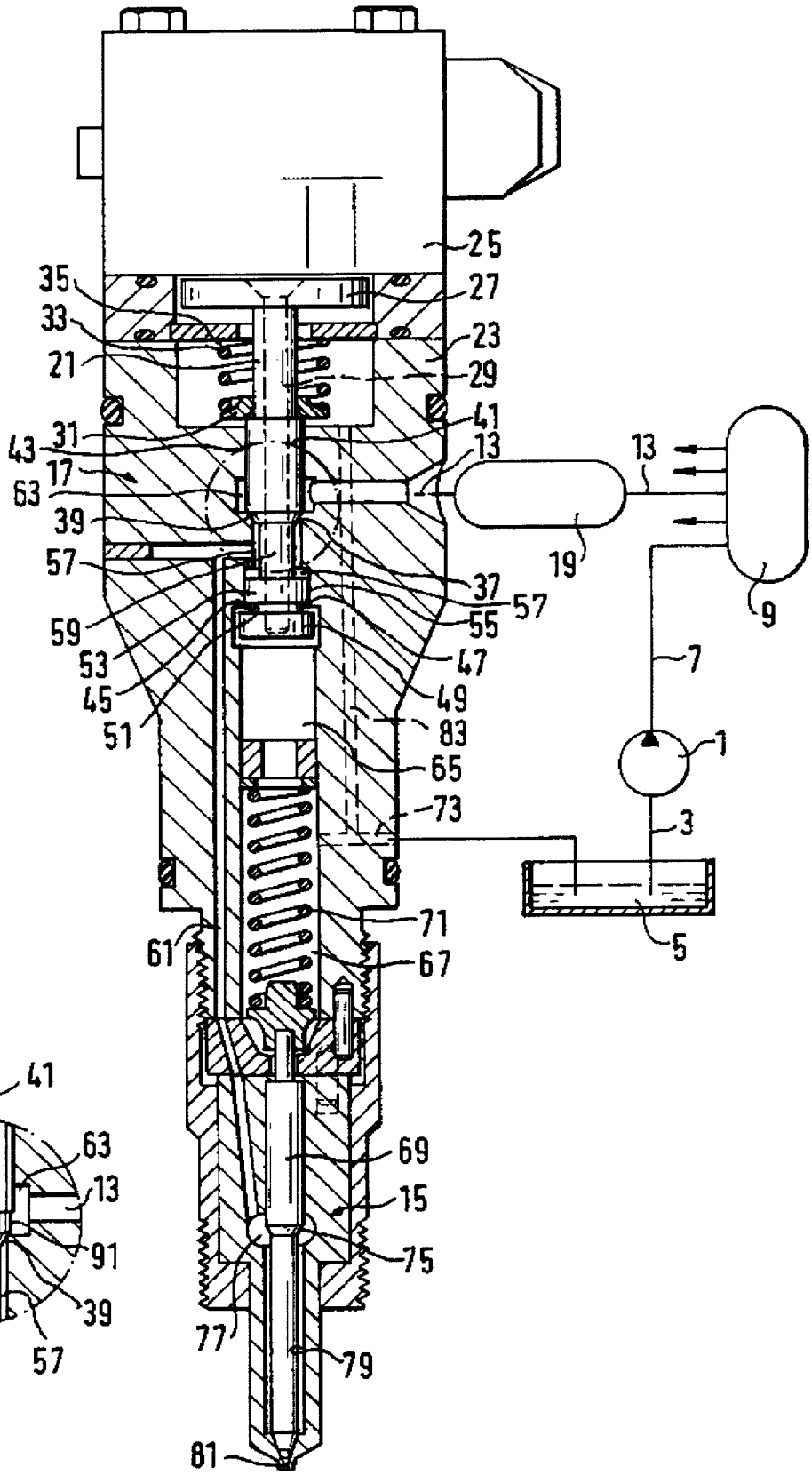
FIG. 1 is a schematic representation of the fuel injection device, with a longitudinal section through the control valve and the injection valve.

In the fuel injection device shown in FIG. 1, a high pressure fuel pump 1 communicates on the suction side with a low pressure chamber 5, which is filled with fuel, via a fuel supply line 3, and communicates on the pressure side with a high pressure accumulation chamber 9 via a supply line 7. High pressure lines 13 lead from the high pressure accumulation chamber 9 to the individual injection valves 15, which protrude into the combustion chamber of the internal combustion engine to be fed; to control the injection event, an electric control valve 17 is inserted at each injection valve 15 in the respective high pressure line 13. Furthermore, an additional pressure storage chamber 19 is provided in each high pressure line 13 between the high pressure accumulation chamber 9 and the control valve 17, via whose dimensioning the course of injection can be shaped at the injection valve.

The control valve is embodied as a 3/2-way valve, whose pistonlike valve member 21 is actuated by an adjusting magnet 25, which acts upon its one face end.

The adjusting magnet 25 is attached to the valve member via an armature plate 27 by means of a screw 29 in an axial blind bore of the valve member 21 and works in opposition to a restoring spring, which is fixed between the housing 23 and the spring plate 31 and which is disposed in a spring chamber 35 of the control valve 17.

The pistonlike valve member 21 has two sealing faces oriented toward one another, of which a first conical valve sealing face 37 cooperates with a conical valve seat 39.

This conical valve sealing face 37 is formed by a conical narrowing of the cross section of a guide piston part 41, which sealingly slides in a guide bore 43 and protrudes into the spring chamber 35 with its end remote from the conical valve sealing face 37. The conical valve seat 39 is formed by a diameter reduction of the guide bore 43; when the valve is closed the sealing takes place via the outer diameter on the valve seat 39. The second valve sealing face is embodied as a flat sealing face 45 and cooperates with a flat valve seat 47. The flat valve sealing face 45 is disposed on an axial annular face of an annular rib 49 that defines the valve member 21 on the side remote from the adjusting magnet 25, the axial annular face being oriented toward the valve sealing surface 37. The flat valve seat 47 is formed by an annular step at the guide bore 43, which is embodied as a stepped bore.

On the side which carries the sealing face 45, the annular rib 49 adjoins a first annular groove 51, which is defined on the other side by a reaspiration collar 53. This reaspiration collar 53 has only a slightly smaller outer diameter than the guide bore 43 in this region, which is embodied as a stepped bore, and thus on its circumferential face forms a throttle segment 55, which precedes the flat seat valve and feeds into an annular chamber 57 on the side remote from the first annular groove 51, which annular chamber 57 is formed in the guide bore 43 between the conical valve sealing face 37 and the reaspiration collar 53 and from which a pressure line 61 leads to the injection valve 15. The throttle 55 can also be formed by a slight diameter difference between the reaspiration collar 53 and the guide piston part 41 given the same diameter of the guide bore 43 in these regions; then the diameter of the guide piston part 41 should be roughly 5 to 30 μm greater than the diameter of the reaspiration collar 53 so that a corresponding throttling annular gap results at the throttle 55.

A pressure chamber 63, into which the high pressure line 13 feeds, adjoins the larger diameter of the conical valve sealing face 37.

The annular rib 49 protrudes with its end remote from the flat valve seat 47 into a relief chamber 65, which extends axially away from the adjusting magnet 25 into a spring chamber 67 of the injection valve 15, in which chamber 67 a valve spring 71 is disposed, which acts upon a valve member 69 of the injection valve 15 in the closing direction and from which chamber 67 a return line 73 leads into the low pressure chamber 5.

The valve member 69 of the injection valve 15 is provided in a known manner with a conical pressure shoulder 75, which protrudes into a pressure chamber 77, which is connected to the pressure line 61, in such a way that the pressure in the pressure chamber 77 acts upon the valve member 69 in the opening direction. Furthermore an injection conduit 79 leads from the pressure chamber 77 along the valve member 69 to one or several injection openings 81 of the injection valve 15, which are controlled by the sealing face on the tip of the valve member 69, and into the combustion chamber, not shown, of the engine to be fed.

Furthermore, the spring chamber 35 of the control valve 17 communicates via a connecting bore 83 with the return line 73 so that the face ends of the valve member 21 are pressure balanced.

The stroke motion of the valve member 21 is defined by the contact of each of the valve sealing faces 37, 45 on one of the valve seats 39, 47.

The fuel injection device according to the invention works in the following manner.

The high pressure fuel pump 1 supplies the fuel from the low pressure chamber 5 to the high pressure accumulation chamber 9 and thus builds up a high fuel pressure in it. This high fuel pressure continues via the high pressure lines 13 into the pressure chamber 63 of the individual control valves 17 at the injection valves 15 and also fills the respective pressure storage chambers 19. In the rest state, that is when the injection valve 15 is closed, the adjusting magnet 25 on the control valve 17 is switched off so that the restoring spring 33 holds the valve member 21 via the spring plate 31 with the conical valve sealing face 37 contacting the conical valve seat 39 so that the communication is closed between the pressure chamber 63, which is under high fuel pressure, and the annular chamber 57, which is permanently connected to the pressure line 61 to the injection valve 15, and the communication is open from the annular chamber 57 into the relief chamber 65.

When an injection takes place at the injection valve, the adjusting magnet 25 is supplied with current and moves the valve member 21 of the control valve 17 against the restoring force of the spring (33) until its flat valve sealing face 45 contacts the flat valve seat 47. The chamber's 57 communication of the annular chamber 57 with the relief chamber 65 is closed and communication of the annular chamber 57 with the pressure line 61 is opened so that the high fuel pressure is now transmitted from the pressure chamber 63 via the annular chamber 57 and the pressure line 61 to the pressure chamber 77 of the injection valve 15 and the injection takes place at the injection openings 81 in a known manner via the lifting of the valve member 69 from its valve seat. It is to be noted that the annular chamber 57 includes that area just above the reaspiration collar 53; therefore, when the valve member 21 moves so that the flat valve seat 47 seats against the flat valve sealing face the volume of the annular chamber 57 becomes less by the volume just above the reaspiration collar due to the movement of the valve member 21.

When the injection comes to an end, the adjusting magnet 25 is switched off again and the restoring spring 33 moves the valve member 21 back into contact of the conical valve sealing face 37 against the conical valve seat 39. During this closing process, the reaspiration collar 53 unblocks a determined reaspiration volume in the annular chamber 57 which increases by a volume of the area just above the reaspiration collar, by means of which the volume of fuel under high pressure in the pressure line 61 extends so that the fuel pressure in the pressure line 61 becomes less because of the increase in the volume of the annular chamber 57 and at the injection valve 15 drops very rapidly below the closing pressure of the injection valve 15 and the injection valve 15 reliably closes. The further flow of the fuel out of the annular chamber 57 or the pressure line 61 then takes place via the throttle 55 on the reaspiration collar 53 so that a set residual pressure remains in the pressure line 61 until the following injection event.

Figure 2:
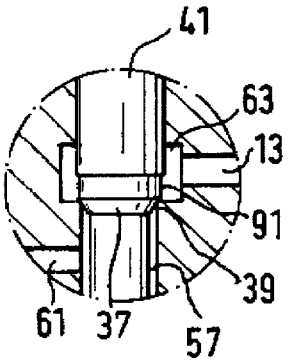
FIG. 2 shows an enlarged detail from the control valve in FIG. 1, in which the arrangement of an additional annular shoulder is shown on the valve member.

In the detail from FIG. 1 shown in FIG. 2, an additional annular shoulder 91 is provided on the valve member 21 in the region of the pressure chamber 63, which shoulder is formed by a diametrical narrowing of the guide piston part 41. This annular shoulder 91 serves as a relief or safety valve, which effects an opening of the conical valve seat 39 at an excess pressure in the high pressure line 13 of roughly 10%. Pressure peaks in the pressure storage chamber occurring at the end of injection can be decreased by this relief. The annular shoulder 91 is dimensioned so that it effects only a slight opening stroke of the valve member 21 so that the flat seat valve does not completely close and the excess pressure can be released out of the pressure chamber 63, into the annular chamber 57 and further on into the relief chamber 65.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines, having a high pressure fuel pump (1), which supplies fuel from a low pressure chamber (5) to a high pressure accumulation chamber (9), which communicates via high pressure lines (13) with injection valves (15) which protrude into a combustion chamber of the engine to be fed, opening and closing motion of said injection valves is controlled by an electrically triggered control valve (17) disposed in the high pressure line (13) at the injection valve (15), the control valve (17) has a pistonlike valve member (21), which has first and second valve sealing surfaces oriented toward one another, which cooperate with first and second valve seats, of which said first valve sealing surface (37) opens the communication of the high pressure line (13) to the injection valve (15) and said second valve sealing surface (45) on an annular rib (49) opens a communication of the injection valve (15) to a relief chamber (65) downstream of said second valve sealing surface, wherein the second valve sealing surface (45) downstream of a reaspiration collar (53) on the valve member (21), which upon lifting of the second valve sealing surface (45) from its seat (47) at the end of an injection, unblocks a reaspiration volume upstream of said reaspiration collar, into which a portion of the fuel quantity upstream of the injection valve is released.

2. The fuel injection device according to claim 1, in which a circumferential surface of the reaspiration collar (53) has only a slight play between said circumferential surface and a wall of a guide bore (43), which bore guides the valve member (21) and thus forms a throttle (55) upstream of the valve seat (47), which seat cooperates with the second valve sealing surface (45).

3. The fuel injection device according to claim 1, in which said first valve sealing surface on the valve member is embodied as a conical valve sealing surface (37), which seals on an outer cone diameter, which cooperates with a conical valve seat (39), which is formed at the guide bore (43).

4. The fuel injection device according to claim 2, in which said first valve sealing surface on the valve member is embodied as a conical valve sealing surface (37), which seals on the outer cone diameter, which cooperates with a conical valve seat (39), which is formed at the guide bore (43).

5. The fuel injection device according to claim 1, in which the second valve sealing surface on the valve member (21) is embodied as a flat valve sealing surface (45), which is disposed on an axial annular surface of said annular rib (49), which defines the valve member (21) and is oriented toward the conical valve sealing surface (37), which flat valve sealing surface (45) cooperates with a flat valve seat (47), which is formed on a step of the guide bore (43).

6. The fuel injection device according to claim 2, in which the second valve sealing surface on the valve member (21) is embodied as a flat valve sealing surface (45), which is disposed on an axial annular surface of said annular rib (49), which defines the valve member (21) and is oriented toward the conical valve sealing surface (37), which flat valve sealing surface (45) cooperates with a flat valve seat (47), which is formed on a step of the guide bore (43).

7. The fuel injection device according to claim 3, in which a first annular groove (51) is provided between the reaspiration collar (53) and the annular rib (49) and a second annular groove (59) is provided between the conical valve sealing surface (37) and the reaspiration collar (53).

8. The fuel injection device according to claim 5, in which a first annular groove (51) is provided between the reaspiration collar (53) and the annular rib (49) and a second annular groove (59) is provided between the conical valve sealing surface (37) and the reaspiration collar (53).

9. The fuel injection device according to claim 3, in which a guide piston part (41), which adjoins the side of the conical valve sealing surface (37) remote from the conical valve seat (39), sealingly slides in the guide bore (43).

10. The fuel injection device according to claim 4, in which a guide piston part (41), which adjoins the side of the conical valve sealing surface (37) remote from the conical valve seat (39), sealingly slides in the guide bore (43).

11. The fuel injection device according to claim 9, in which on a larger diameter portion, the conical valve seat (39) adjoins a pressure chamber (63), which encompasses the guide piston part (41) and into which the high pressure line (13) feeds.

12. The fuel injection device according to claim 10, in which on a larger diameter portion, the conical valve seat (39) adjoins a pressure chamber (63) , which encompasses the guide piston part (41) and into which the high pressure line (13) feeds.

13. The fuel injection device according to claim 7, in which with a smaller diameter portion, the conical valve seat (39) adjoins an annular chamber (57) formed between the second annular groove (59) and the wall of the guide bore (43), from which chamber (57) a pressure line (61) leads to the injection valve (15) and which is defined on another end by the reaspiration collar (53).

14. The fuel injection device according to claim 13, in which on a side remote from the annular chamber (57), the flat valve seat (47) adjoins a relief chamber (65), from which a return line (73) flows into the low pressure chamber (5).

15. The fuel injection device according to claim 1, in which a stroke motion of the valve member (21) is defined by a contact of the first valve sealing surface (37) on the first valve seat (39) and by the second valve sealing surface (45) contacting the second valve seat.

16. The fuel injection device according to claim 1, in which individual components of the valve member (21) are connected to an armature plate (27) of an adjusting magnet which actuates the control valve (17) by means of a screw (29), which protrudes into an axial blind bore in the valve member (21).

17. The fuel injection device according to claim 1, in which an additional pressure storage chamber (19) is provided at each injection valve (15) between the high pressure accumulation chamber (9) and the control valve (17).

18. The fuel injection device according to claim 11, in which an annular shoulder (91) is provided on the guide piston part (41) in the region of the pressure chamber (63), which is permanently connected to the high pressure line (13), which annular shoulder (91) is acted upon by pressure in the pressure chamber (63) in the opening direction of the conical valve sealing surface (37) of the valve seat (39).

19. The fuel injection device according to claim 1, in which the diameter of the guide piston part (41) is slightly greater than the diameter of the reaspiration collar (53).

20. The fuel injection device according to claim 19, in which the difference between the diameters of the guide piston part (41) and the reaspiration collar (53) produces a throttling annular gap at the throttle (55), having a gap width of from roughly 5 μm to 30 μm.

* * * * *